United States Patent [19]

Doubleday

[11] 3,961,647

[45] June 8, 1976

[54] SUCTION PIPE HAVING MEANS TO SUPPORT A SUPPLY CONDUIT

[76] Inventor: Eric G. Doubleday, Am Kraherwald 167, 7 Stuttgart-W, Germany

[22] Filed: Jan. 6, 1975

[21] Appl. No.: 539,012

[52] U.S. Cl. ..... 138/103; 174/47; 248/54 R

[51] Int. Cl.[2] ..... F16L 11/12; F16L 55/00

[58] Field of Search ..... 138/103, 108; 174/47, 174/99 R, 154; 248/51, 52, 54 R

[56] References Cited

UNITED STATES PATENTS

| | | | |
|---|---|---|---|
| 2,819,858 | 1/1958 | Mittendorf | 248/54 R |
| 2,896,009 | 7/1959 | Caveney | 138/103 |
| 3,327,049 | 6/1967 | Brown et al. | 174/47 |

FOREIGN PATENTS OR APPLICATIONS

| | | | |
|---|---|---|---|
| 524,909 | 5/1956 | Canada | 174/47 |
| 14,611 | 12/1906 | United Kingdom | 138/108 |
| 884,479 | 12/1961 | United Kingdom | 248/54 R |

*Primary Examiner*—Richard E. Aegerter
*Assistant Examiner*—Richard R. Stearns
*Attorney, Agent, or Firm*—Walter Becker

[57] ABSTRACT

A suction pipe for a suction operated cleaner, especially a sectioned suction pipe, in which the pipe sections are provided with integral extensions thereon forming an axial channel along the outside of the pipe which is open on one side to receive a supply conduit, such as an electric cable.

5 Claims, 5 Drawing Figures

SUCTION PIPE HAVING MEANS TO SUPPORT A SUPPLY CONDUIT

The present invention relates to a suction pipe for cleaning machines, especially for dust suction devices and liquid suction devices, which comprises a plurality of substantially identical pipe sections adapted to be plugged together, and which is equipped with connecting means by means of which an electrical cable pertaining to an auxiliary or additional device adapted to be connected to an end of the suction pipe can be guided along the suction pipe and can be held fast on the latter.

A household vacuum cleaner has become known which comprises a suction pipe that at its free end can be connected to an electric motor driven carpet brush. This suction pipe which is rigid in itself and comprises a length sufficient for the cleaning of the floor while the operator is in upright position, has a special passage which extends in the longitudinal direction of the suction pipe and forms one piece with the mantle of the suction pipe, said passage being closed on all sides and serves for passing through the operating cable of the carpet brush.

With these heretofore known suction pipes, due to the formed-on receiving passage for the operation cable of the auxiliary device there is either a cross section required which during the handling of the suction pipe can no longer be sufficiently grasped, or the suction cross section of the pipe must be kept smaller in a manner which affects the suction power. A further drawback consists in that the plug of the operation cable has to be premounted in the shop. Due to the great length of the heretofore known suction pipe, considerable wrapping and packing material and a considerable space is required as it is desired to store the suction pipe during the intervals between the use of the device. A subdivision of the heretofore known suction pipe in a plurality of substantially indentical suction pipe pieces would result in a rather complicated construction because for each pipe section there would be necessary a plug and a clutch member. A further disadvantage of the above mentioned heretofore known suction pipe with a formed-on receiving passage for the operation cable of the auxiliary device consists in that in case a repair becomes necessary, an exchange of the cable is possible only with difficulty. Moreover, the cable can be coupled by a nozzle which is provided for this purpose.

It is, therefore, an object of the present invention to provide a suction pipe for cleaning machines of the above mentioned general type which will permit with a suction pipe combined from a plurality of pipe sections to obtain an extremely simple cable guiding and cable connection.

These and other objects and advantages of the invention will appear more clearly from the following specification, in connection with the accompanying drawings, in which:

FIG. 1 diagrammatically illustrates a suction pipe for a dust or liquid suction device.

Figure 1:
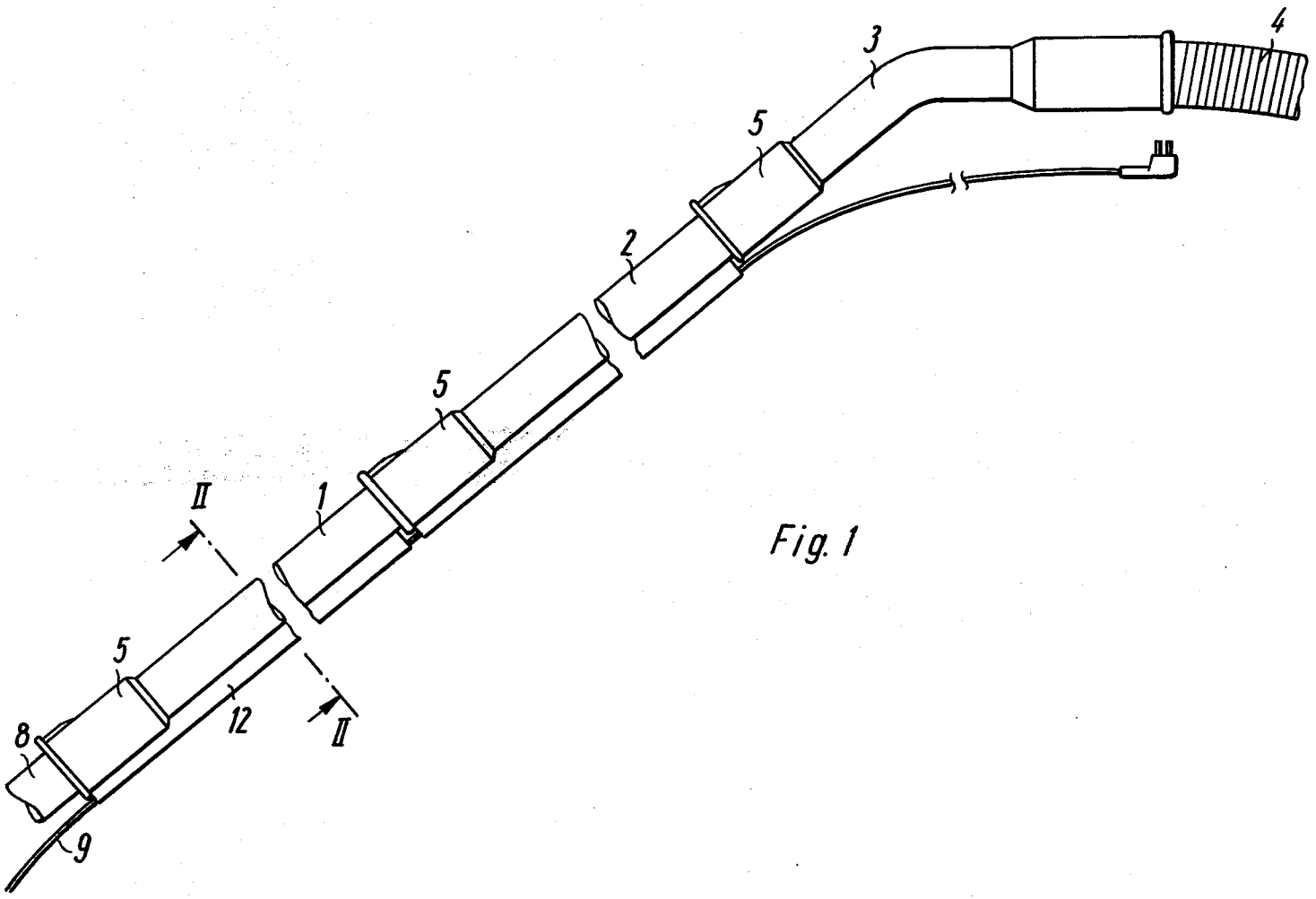

The suction pipe according to the present invention is characterized primarily in that with extruded or extrusion molded pipe sections of synthetic material, the connecting means for the operation cable of an auxiliary device are designed as extensions extending in longitudinal direction of the pipe sections and extending over at least a portion of the length of the pipe sections while being spaced from the mantle surface of the pipe sections and forming one piece with the pipe sections, said extensions being inclined with regard to a central longitudinal plane located in the longitudinal axis of the pipe sections.

According to a preferred design of the present invention, the extensions may in their cross sections extending transverse to the longitudinal axis of the pipe sections be designed in the manner of a hook. With a preferred embodiment of the invention, each pipe section is provided with two wall forming extensions which are symmetrically inclined with regard to a longitudinal central plane.

According to a further development of the invention, the two respective walls pertaining to one pipe section may extend at least approximately over the length of the pipe sections, preferably over at least one major portion of the length of the pipe sections.

In order to permanently safeguard the position of the operation cable, when the operation cable is mounted along the suction pipe by means of the extensions according to the invention, it is expedient when at least one of the two walls inclined relative to each other and pertaining to a pipe section have their free end section continued in an angled-off marginal zone. In this connection it may be advantageous at both walls to provide one each of two angled-off marginal zones which are directed away from each other. In this instance, the clear distance between the two walls is dimensioned so close that the receiving cross section for the operation cable has a narrower width than the diameter of the operation cable. In this way, it will be realized that for purposes of inserting the cable between the two walls, the marginal zones of said walls have to be spread away from each other. After such elastic deformation necessary for receiving the cables, the said walls return to their starting position in which they prevent the inserted cable from leaving the cable passage which is formed primarily by the two walls.

While with the just described embodiments having marginal zones pointing away from each other at the two walls, the insertion of the operation cable for the auxiliary device can be particularly facilitated. It is possible when modifying the said device, to improve the holding effect exerted upon the inserted operation cable by providing angled-off marginal zones on the free end sections of the walls directed toward each other and pertaining to a pipe section, said marginal zones being directed toward each other.

Advantageously, the arrangement may in this connection be such that the marginal zones directed against each other, in longitudinal direction of the pipe sections are spaced from each other and alternately are arranged on one and the other two walls forming the extensions.

Referring now to the drawings in detail, the suction pipe according to FIG. 1, comprises a plurality of substantially identical pipe sections which have a length of from 30 to 60 centimeters and are adapted to be plugged to each other. Of these pipe sections, the drawing shows only the two pipe sections 1 and 2. The illustrated suction pipe furthermore comprises an angled-off manual pipe 3 which similar to the pipe sections 1 and 2 and the hose 4 connected to the hand pipe and shown only over a short piece of its length is injection molded from duroplastic synthetic material. The hand pipe 3, similar to the two pipe sections 1 and 2 ends in a receiving sleeve 5 into which the respective end section of a pipe section facing away from the receiving sleeve and designed as plug section can be introduced and can be fastened with slide fit.

The receiving sleeve 5 of the lower pipe section 1 arranged in the drawing at the free end of the suction pipe serves for connecting the suction pipe to the connecting section 8 of a non-illustrated electric motor-driven adapter, for instance, a brush. The operation cable pertaining to this adapter is shown at 9 in FIG. 1. In order to assure that this operation cable during the operation of the adapter and during the handling of the suction pipe will not interfere, it can be displaced along the suction pipe in such a way that it can easily be separated therefrom when taking apart the suction pipe, there can, if necessary, be exchanged for the operation cable of another adapter.

The connecting means by which the operation cable 9 pertaining to the non-illustrated auxiliary device is guided along the suction pipe and can be held at said suction pipe, comprises two extensions 11 and 12. These extensions from one piece with the mantle 10 of the pipe sections 1, 2 and are designed as passage walls. The said extensions 11 and 12 are directed at an incline toward a longitudinal central plane 13 located in the longitudinal axis of the pipe sections. The two walls 11 and 12 continue at their free end sections so as to form thin-walled marginal zones 14, 15. These marginal zones are with the embodiment according to FIGS. 1 and 2 directed against each other and in spaced relationship are located opposite to each other while the distance therebetween is slightly less than the outer diameter of the operation cable 9. This cable 9 can therefore easily be pressed into the passage 16 surrounded by the walls 11 and 12, and by the mantle 10 and the two marginal zones 14 and 15, where it is then safely mounted during the handling of the suction pipe and the adapter.

Figure 3:
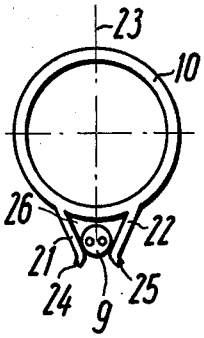
FIG. 3 illustrates a cross section similar to that of FIG. 2 of an embodiment which is somewhat modified over the embodiment of FIGS. 1 and 2.

With the embodiment according to FIG. 3, the two passage walls 21 and 22 likewise form one piece with the mantle 10 of the pipe sections but are inclined to a greater extent toward the common longitudinal central plane 23 than is the case with the previously described embodiment. In order to facilitate the insertion of the operation cable 9 into the receiving passage defined by the walls 21 and 22, these walls 21 and 22 end in marginal zones 24 and 25 which are directed away from each other. The distance between the two walls at the areas where they merge with the marginal zones 24 and 25 is dimensioned so slight that during the introduction of the operation cable 9 into and its removal from the receiving passage 26, the two walls 21 and 22 have to be elastically bent away from the common longitudinal central plane 23, whereby an accidental pulling out of the operation cable 9 during the handling of the suction pipe will be safely prevented.

Figure 5:
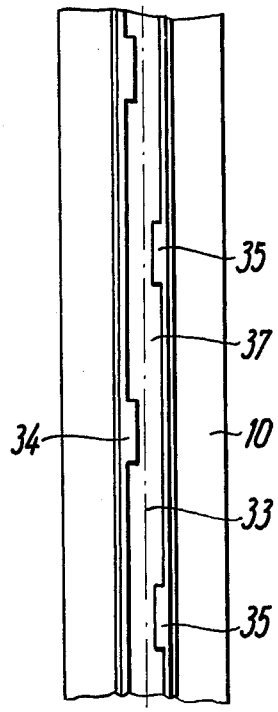
FIG. 5 is a top view of the suction pipe.
Figure 2:
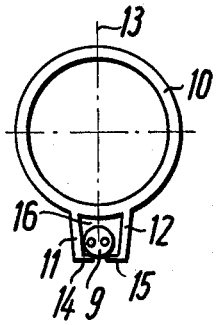
FIG. 2 is a section taken along the line II—II of FIG. 1, said section being passed through one of the pipe sections pertaining to the suction pipe.
Figure 4:
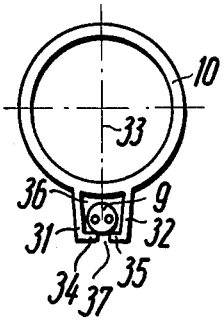
FIG. 4 is a cross section similar to that of FIG. 2, as seen when looking upon its actuating means.

According to the embodiment of the invention as illustrated in FIGS. 4 and 5, the two side walls 31 and 32 arranged on the mantle of the pipe sections, similar to the embodiment according to FIGS. 1 and 2, are slightly inclined toward the common longitudinal central plane 33. The side walls 31 and 32 likewise end in marginal zones 34 and 35 which, however, in the manner shown in FIG. 5, extend only over a small portion of the length of a pipe section and are in the longitudinal direction of the pipe sections offset relative to each other in such a way that therebetween remains a meander-shaped gap 37 through which the operation cable 9 can, in a direction transverse to its longitudinal direction, be pressed into the receiving passage 36. The meander-shaped course of the gap 37 will assure that the operation cable 9 when being pulled out of the receiving passage 36 must be bent laterally on one of the ear-shaped marginal zones 34, 35, but cannot be removed from the receiving passage 36 merely by a pull exerted in its longitudinal direction. This additional securing of the operation cable against undesired loosening of the suction pipe has by no means proved to be an impediment when taking the suction pipe apart, particularly in view of the fact that the operation cable 9 can by means of a few manual operations subsequently be passed by the marginal zone sections 34 and 35 which are offset relative to each other.

It is, of course, to be understood that the present invention is, by no means, limited to the specific showing in the drawings, but also comprises any modifications within the scope of the appended claims.

What is claimed is:

1. In a suction pipe for a suction operated cleaning device, a plurality of pipe sections having means for assembly by end to end telescopic engagement, and means on said pipe sections for supporting an electric cable, the means on each section integral with the section comprising a pair of thin, resilient longitudinal walls extending along substantially the length of said pipe section to form a channel opening outwardly, said walls being inclined toward a radial plane between the walls and having restrictive formations along their outer edges to reduce the space between the walls to less than the space between said walls at their base along said pipe, so that a cable in the channels will be retained by the restrictive formations on the outer edges of said walls.

2. A suction pipe according to claim 1 in which the outer edge of at least one of said walls has a portion extending laterally toward the other wall.

3. A suction pipe according to claim 1 in which the outer edges of both of said walls have portions each extending laterally toward the other wall.

4. A suction pipe according to claim 3 in which said outer edges of said walls each contain laterally disposed portions.

5. A suction pipe according to claim 3 in which the portions are uniformly spaced so as to provide a meandering gap through which the conduit is insertable into said channel.

* * * * *

UNITED STATES PATENT OFFICE

CERTIFICATE OF CORRECTION

Patent No. 3,961,647 Dated June 8, 1976

Inventor(s) Eric G. Doubleday

It is certified that error appears in the above-identified patent and that said Letters Patent are hereby corrected as shown below:

On the Title Page, Item [30] should read

Germany 2401037.5 January 10, 1974

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*